US011697537B2

(12) United States Patent
Holley, Jr.

(10) Patent No.: US 11,697,537 B2
(45) **Date of Patent: *Jul. 11, 2023**

(54) CARRIER FOR CONTAINERS

(71) Applicant: Graphic Packaging International, Inc., Atlanta, GA (US)

(72) Inventor: John Murdick Holley, Jr., Lawrenceville, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 992 days.

This patent is subject to a terminal disclaimer.

(21) Appl. No.: 14/947,234

(22) Filed: Nov. 20, 2015

(65) Prior Publication Data

US 2016/0152389 A1 Jun. 2, 2016

Related U.S. Application Data

(60) Provisional application No. 62/123,910, filed on Dec. 1, 2014.

(51) Int. Cl.
*B65D 71/58* (2006.01)

(52) U.S. Cl.
CPC .. *B65D 71/0022* (2013.01); *B65D 2571/0066* (2013.01); *B65D 2571/00141* (2013.01); (Continued)

(58) Field of Classification Search
CPC ..... B65D 71/0022; B65D 71/26; B65D 71/0029; B65D 71/06; B65D 71/00132; (Continued)

(56) References Cited

U.S. PATENT DOCUMENTS 2,222,211 A 11/1940 Arneson
2,225,822 A 12/1940 Crook
(Continued)

FOREIGN PATENT DOCUMENTS

DE 90 04 439.8 6/1990
EP 0 452 563 10/1991
(Continued)

OTHER PUBLICATIONS

International Search Report and Written Opinion for PCT/US2015/061814 dated Feb. 26, 2016.

*Primary Examiner* — Javier A Pagan
(74) *Attorney, Agent, or Firm* — Womble Bond Dickinson (US) LLP

(57) ABSTRACT

A carrier for holding a plurality of containers. The carrier can comprise a plurality of panels that extends at least partially around an interior of the carrier. The plurality of panels can comprise at least a front panel and a central panel. The interior of the carrier can be divided into a front portion and a back portion by at least the central panel. A divider flap can be foldably connected to the central panel. The divider flap can extend at least partially from the central panel to the front panel. An attachment feature can comprise a hinge panel and an attachment tab. The hinge panel can be foldably connected to the divider flap along a first fold line, and the attachment tab can be foldably connected to the hinge panel along a second fold line. The attachment tab and the front panel can at least partially overlap one another.

51 Claims, 9 Drawing Sheets

(52) U.S. Cl.
CPC ..... *B65D 2571/00388* (2013.01); *B65D 2571/00487* (2013.01)

(58) Field of Classification Search
CPC ..... B65D 71/36; B65D 5/20; B65D 5/4208; B65D 5/48002; B65D 5/48022; B65D 2571/00388; B65D 2571/00487; B65D 2571/0066; B65D 2571/00141; B65D 2571/00438; B65D 2571/00339
USPC ..... 206/193, 190
See application file for complete search history.

(56) References Cited

U.S. PATENT DOCUMENTS 2,227,330 A 12/1940 Turner
2,331,312 A 10/1943 Dorfman
2,336,857 A 12/1943 Gies et al.
2,457,308 A 12/1948 Hall et al.
2,458,281 A 1/1949 Lupton
2,460,108 A 1/1949 Smith et al.
2,525,686 A 10/1950 Kowal
2,535,741 A 12/1950 Lighter
2,537,615 A 1/1951 Ameson
2,660,361 A 11/1953 Tyrseck
2,689,061 A 9/1954 Gray
2,721,001 A 10/1955 Hasselhoff
2,772,020 A 11/1956 Kramer
2,776,072 A 1/1957 Forrer
2,783,916 A 3/1957 Hodapp
2,887,245 A 5/1959 Levkoff
2,977,021 A 3/1961 Shiels, Jr.
2,991,908 A 7/1961 Conescu
2,993,619 A 7/1961 Arneson
3,029,977 A 4/1962 Arneson
3,053,411 A 9/1962 Struble et al.
3,128,906 A 4/1964 Forrer
3,190,487 A 6/1965 Wood
3,191,800 A 6/1965 Kowal
3,194,478 A 7/1965 Weiss
3,229,849 A 1/1966 Spillson
3,236,414 A 2/1966 Slevin, Jr.
3,313,466 A 4/1967 Keith
3,343,742 A 9/1967 Siegler
3,352,452 A 11/1967 Graser
3,432,073 A 3/1969 Forrer
3,554,401 A 1/1971 Wood
3,572,544 A 3/1971 Forrer
3,624,790 A 11/1971 Stout
3,661,297 A 5/1972 Wood
3,669,306 A 6/1972 Forrer
3,672,539 A 6/1972 Forrer
3,709,400 A 1/1973 Arneson
3,721,335 A 3/1973 Grant
3,722,738 A 3/1973 Wright
3,754,680 A 8/1973 Wood
3,784,053 A 1/1974 Stout
3,794,210 A 2/1974 Stout
3,860,113 A 1/1975 Helms
3,893,565 A 7/1975 Rossi et al.
3,917,059 A 11/1975 Wood
3,917,060 A 11/1975 Wood
3,917,061 A 11/1975 Stout
4,000,813 A 1/1977 Stout
4,010,847 A * 3/1977 Wood ..... B65D 71/0022 206/187
4,029,205 A 6/1977 Wood
4,153,158 A 5/1979 Graser et al.
4,171,046 A 10/1979 Bonczyk
4,187,944 A 2/1980 Wood
4,205,748 A 6/1980 Wilson
4,217,983 A 8/1980 Stout
4,243,138 A 1/1981 Wilson
4,250,992 A 2/1981 Gilbert
4,253,564 A 3/1981 Engdahl, Jr.
4,308,950 A 1/1982 Wood
4,318,470 A 3/1982 Montealegre
4,319,682 A 3/1982 Wright et al.
4,362,240 A 12/1982 Elward
4,374,561 A 2/1983 Stout et al.
4,377,252 A 3/1983 Schillinger
4,406,365 A 9/1983 Kulig
4,413,729 A 11/1983 Wood
4,450,956 A 5/1984 Wood
4,469,222 A 9/1984 Graser
4,480,746 A 11/1984 Wood
4,482,055 A 11/1984 Boyle
4,509,640 A 4/1985 Joyce
4,544,092 A 10/1985 Palmer
4,591,090 A 5/1986 Collins et al.
4,610,349 A 9/1986 Schwartz et al.
4,722,437 A 2/1988 Walsh
4,770,294 A 9/1988 Graser
4,782,943 A 11/1988 Blackman
4,782,944 A 11/1988 Engdahl, Jr.
4,792,038 A 12/1988 Cooper
4,927,009 A 5/1990 Stout
5,029,698 A 7/1991 Stout
5,040,672 A 8/1991 DeMaio et al.
5,072,876 A 12/1991 Wilson
5,123,588 A 6/1992 Harris
5,161,732 A 11/1992 Clein et al.
5,167,325 A 12/1992 Sykora
5,191,976 A 3/1993 Stout et al.
5,234,103 A 8/1993 Schuster
5,246,113 A 9/1993 Schuster
5,282,348 A 2/1994 Dampier et al.
5,359,830 A 11/1994 Olson et al.
5,363,954 A 11/1994 Dampier et al.
5,400,901 A 3/1995 Harrelson
5,458,234 A 10/1995 Harris
5,482,203 A 1/1996 Stout
5,484,053 A 1/1996 Harris
5,499,712 A 3/1996 Harrelson
5,518,110 A 5/1996 Harrelson
5,531,319 A 7/1996 Harrelson
5,538,130 A 7/1996 Harrelson
5,538,131 A 7/1996 Harrelson
5,547,074 A 8/1996 Plaxico et al.
5,579,625 A 12/1996 Olson et al.
5,590,762 A 1/1997 Harrelson
5,593,027 A 1/1997 Sutherland
5,611,425 A 3/1997 Holley, Jr.
5,620,094 A 4/1997 Naumann
5,638,956 A 6/1997 Sutherland
5,645,162 A 7/1997 Harrelson
5,649,620 A 7/1997 Harrelson
5,657,864 A 8/1997 Harrelson
5,657,865 A 8/1997 Harrelson
5,680,930 A 10/1997 Stone
5,682,982 A 11/1997 Stonehouse
5,682,985 A 11/1997 Plaxico et al.
5,695,051 A 12/1997 Hart
5,709,298 A 1/1998 Harris
D394,205 S 5/1998 Bates
5,765,685 A 6/1998 Roosa
5,775,487 A 7/1998 Harrelson
5,819,920 A 10/1998 Sutherland
5,855,316 A 1/1999 Spivey
5,871,090 A 2/1999 Doucette et al.
5,878,877 A 3/1999 Sutherland
5,884,756 A 3/1999 Holley, Jr. et al.
5,941,377 A 8/1999 Hart et al.
5,947,273 A 9/1999 Dalrymple et al.
6,003,665 A 12/1999 Stout
6,041,920 A 3/2000 Hart et al.
6,102,197 A 8/2000 Negelen
6,112,977 A 9/2000 Sutherland et al.
6,131,729 A 10/2000 Eckermann et al.
6,155,962 A 12/2000 Dalrymple et al.
6,168,013 B1 1/2001 Gomes
6,189,687 B1 2/2001 Bakx
6,230,881 B1 5/2001 Collura
6,247,585 B1 6/2001 Holley, Jr.

(56) References Cited

U.S. PATENT DOCUMENTS

| | | | |
|---|---|---|---|
| 6,315,111 | B1 | 11/2001 | Sutherland |
| 6,321,906 | B1 | 11/2001 | Wein |
| 6,341,689 | B1 | 1/2002 | Jones |
| 6,371,287 | B1 | 4/2002 | Jones et al. |
| 6,571,941 | B2 | 6/2003 | Holley, Jr. |
| 6,695,137 | B2 | 2/2004 | Jones et al. |
| 6,736,260 | B2 | 5/2004 | Gomes et al. |
| 6,802,802 | B2 | 10/2004 | Woog |
| 6,814,228 | B2 | 11/2004 | Sutherland |
| 6,938,756 | B2 | 9/2005 | Schuster |
| 7,011,209 | B2 | 3/2006 | Sutherland et al. |
| 7,025,197 | B2 | 4/2006 | Sutherland |
| 7,070,045 | B2 | 7/2006 | Theelen |
| 7,128,206 | B2 | 10/2006 | Kohler |
| 7,134,547 | B2 | 11/2006 | Auclair |
| 7,207,934 | B2 | 4/2007 | Schuster |
| 7,374,038 | B2 | 5/2008 | Smalley |
| 7,448,492 | B2 | 11/2008 | Sutherland |
| 7,472,791 | B2 | 1/2009 | Spivey, Sr. |
| 7,552,820 | B2 | 6/2009 | Kohler |
| 7,604,116 | B2 | 10/2009 | Schuster |
| 7,644,817 | B2 | 1/2010 | Sutherland |
| 7,677,387 | B2 | 3/2010 | Brand et al. |
| 7,753,195 | B2 | 7/2010 | Cuomo |
| 7,762,395 | B2 | 7/2010 | Sutherland et al. |
| 7,762,397 | B2 | 7/2010 | Coltri-Johnson et al. |
| 7,793,780 | B2 | 9/2010 | Smalley |
| 8,020,695 | B2 | 9/2011 | Brand |
| 8,297,437 | B2 | 10/2012 | Smalley et al. |
| 8,770,397 | B2 | 7/2014 | Holley, Jr. |
| 2002/0077236 | A1 | 6/2002 | Chalendar et al. |
| 2002/0117407 | A1 | 8/2002 | Holley |
| 2003/0111363 | A1 | 6/2003 | Theelen |
| 2003/0159950 | A1 | 8/2003 | Jones et al. |
| 2003/0213705 | A1 | 11/2003 | Woog |
| 2004/0026269 | A1 | 2/2004 | Cuomo |
| 2004/0050722 | A1 | 3/2004 | Schuster |
| 2004/0094435 | A1 | 5/2004 | Auclair et al. |
| 2005/0211577 | A1 | 9/2005 | Bakx |
| 2005/0218014 | A1 | 10/2005 | Schuster |
| 2005/0230273 | A1 | 10/2005 | Kohler |
| 2006/0091024 | A1 | 5/2006 | Cuomo |
| 2006/0148629 | A1 | 7/2006 | Cuomo |
| 2006/0157545 | A1 | 7/2006 | Auclair |
| 2007/0000980 | A1 | 1/2007 | Oliveira |
| 2007/0017839 | A1 | 1/2007 | Sutherland |
| 2007/0029212 | A1 | 2/2007 | Smalley |
| 2007/0151873 | A1 | 7/2007 | Schuster |
| 2008/0210581 | A1 | 9/2008 | Brand |
| 2009/0008273 | A1 | 1/2009 | Smalley |
| 2010/0006458 | A1 | 1/2010 | Wilkins et al. |
| 2010/0072086 | A1 | 3/2010 | Smalley |
| 2011/0048975 | A1 | 3/2011 | Brand |
| 2011/0198347 | A1 | 8/2011 | Brand |
| 2015/0246746 | A1* | 9/2015 | Brand ..... B65D 71/0022 229/117.13 |
| 2015/0321816 | A1* | 11/2015 | Holley, Jr. ..... B65D 71/0014 229/120.12 |

FOREIGN PATENT DOCUMENTS

| | | |
|---|---|---|
| EP | 1 319 607 | 6/2003 |
| EP | 1 852 359 | 11/2007 |
| EP | 2 102 073 | 9/2010 |
| FR | 2 825 074 | 11/2002 |
| GB | 926874 | 5/1963 |
| WO | WO 97/05026 | 2/1997 |
| WO | WO 99/01356 | 1/1999 |
| WO | WO 2006/020525 | 2/2006 |
| WO | WO 2008/089124 | 7/2008 |

* cited by examiner

CARRIER FOR CONTAINERS

CROSS-REFERENCE TO RELATED APPLICATIONS

This application claims the benefit of U.S. Provisional Patent Application No. 62/123,910, filed on Dec. 1, 2014.

INCORPORATION BY REFERENCE

The disclosure of U.S. Provisional Patent Application No. 62/123,910, which was filed on Dec. 1, 2014, is hereby incorporated by reference for all purposes as if presented herein in its entirety.

BACKGROUND OF THE DISCLOSURE

The present disclosure generally relates to carriers or cartons for holding and displaying containers. More specifically, the present disclosure relates to basket-style carriers.

SUMMARY OF THE DISCLOSURE

In general, one aspect of the disclosure is directed to a carrier for holding a plurality of containers. The carrier can comprise a plurality of panels that extends at least partially around an interior of the carrier. The plurality of panels can comprise at least a front panel and a central panel. The interior of the carrier can be divided into a front portion and a back portion by at least the central panel. A divider flap can be foldably connected to the central panel. The divider flap can extend at least partially from the central panel to the front panel. An attachment feature can comprise a hinge panel and an attachment tab. The hinge panel can be foldably connected to the divider flap along a first fold line, and the attachment tab can be foldably connected to the hinge panel along a second fold line. The attachment tab and the front panel can at least partially overlap one another.

In another aspect, the disclosure is generally directed to a blank for forming a carrier for holding a plurality of containers. The blank can comprise a plurality of panels comprising at least a front panel and a central panel. The central panel can be for at least partially dividing an interior of the carrier formed from the blank into a front portion and a back portion. A divider flap can be foldably connected to the central panel. The divider flap can be for extending at least partially from the central panel to the front panel when the carrier is formed from the blank. An attachment feature can comprise a hinge panel and an attachment tab. The hinge panel can be foldably connected to the divider flap along a first fold line, and the attachment tab can be foldably connected to the hinge panel along a second fold line. The attachment tab and the front panel can be for at least partially overlapping one another when the carrier is formed from the blank.

In another aspect, the disclosure is generally directed to a method of forming a carrier for containing a plurality of containers. The method can comprise obtaining a blank. The blank can comprise a plurality of panels comprising at least a front panel and a central panel, a divider flap foldably connected to the central panel, and an attachment feature comprising a hinge panel and an attachment tab. The hinge panel can be foldably connected to the divider flap along a first fold line, and the attachment tab can be foldably connected to the hinge panel along a second fold line. The method further can comprise forming an interior of the carrier by respectively folding the plurality of panels. The forming the interior of the carrier can comprise positioning the central panel to at least partially divide the interior of the carrier into a front portion and a back portion and positioning the divider flap to extend at least partially from the central panel to the front panel so that the attachment tab and the front panel at least partially overlap one another.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Carriers according to the present disclosure can accommodate containers of numerous different shapes. For the purpose of illustration and not for the purpose of limiting the scope of the disclosure, the following detailed description describes beverage containers (e.g., glass bottles or plastic containers) at least partially disposed within the carrier embodiments. In this specification, the terms "inner," "interior," "outer," "exterior," "lower," "bottom," "upper," "top," "front," "forward," "back," and "rearward" indicate orientations determined in relation to fully erected carriers.

Figure 1:
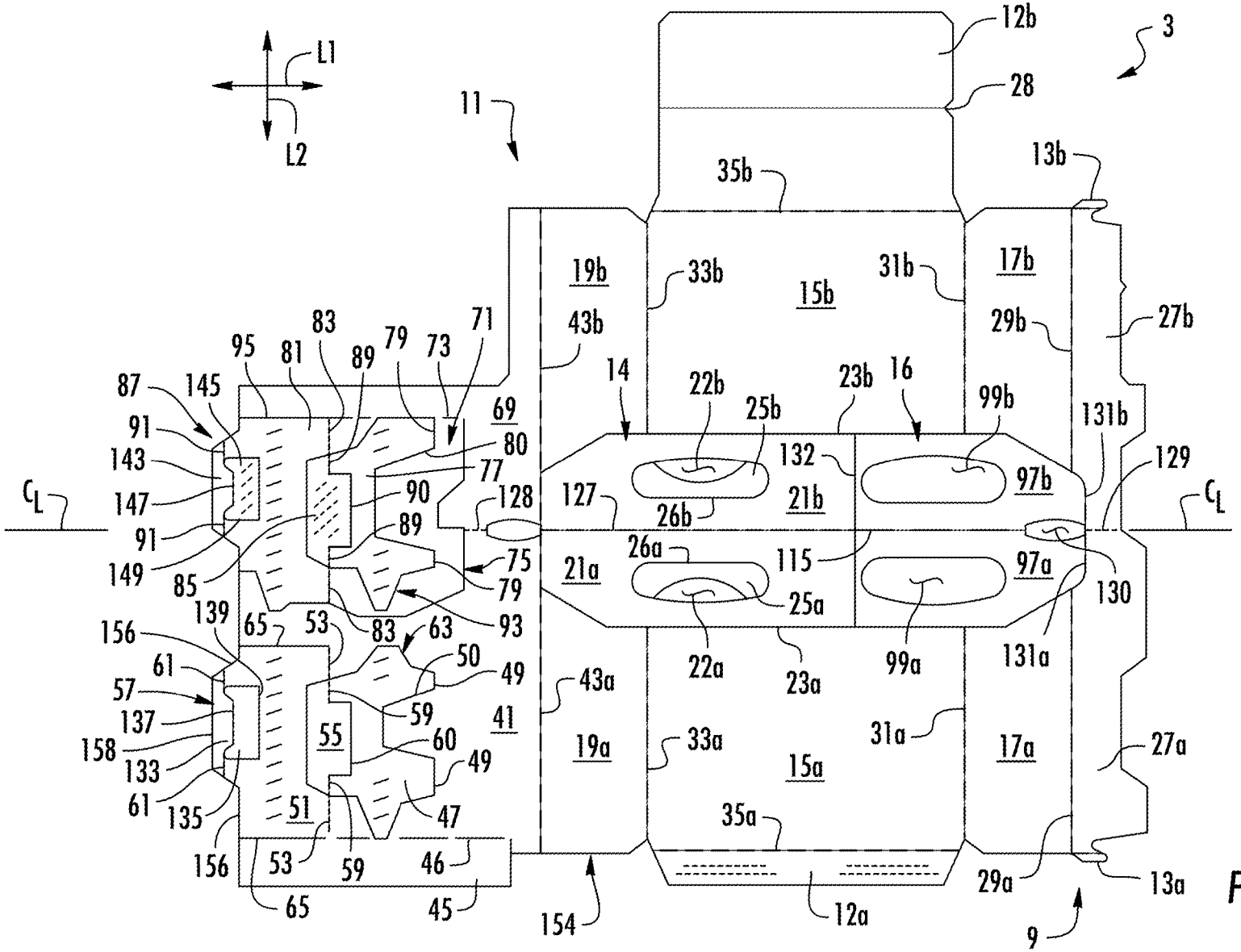
FIG. 1 is an exterior plan view of a blank used to form a carrier according to an exemplary embodiment of the disclosure.

FIG. 1 is a plan view of an exterior side 1 of the blank 3 used to form a package or basket-style carrier 5 (FIGS. 4-9), in accordance with an exemplary embodiment of the present disclosure. As shown in FIG. 5, the carrier 5 is sized to contain six containers C, three containers being contained in a front portion of the carrier and three containers being contained in a back portion of the carrier. The carrier can be sized and shaped to hold more or less than six containers C without departing from the disclosure. In the illustrated embodiment, the carrier 5 includes a reinforced handle 150 (FIGS. 3-5), which can include a handle panel 14 and a handle reinforcement panel 16.

The carrier blank 3 has a longitudinal axis L1 and a lateral or transverse axis L2. The carrier blank 3 has a front portion 9, a back portion 11, a bottom panel 12*b* foldably connected to the back portion, and a bottom attachment flap 12*a* foldably connected to the front portion. In the illustrated embodiment, the front portion 9 and back portion 11 are for being folded about a longitudinal centerline CL (FIG. 1) when the carrier blank 3 is formed into the carrier 5. As discussed in more detail below, the carrier blank 3 is formed into the carrier 5 by folding the carrier blank about the centerline CL so that the front portion 9 and the back portion 11 are generally overlapped.

In the illustrated embodiment, the front portion 9, comprises a front panel 15*a* foldably connected to a first side panel 17*a* and a second side panel 19*a*. A front central flap 27*a* is foldably connected to the first side panel 17*a* at a lateral fold line 29*a*. Lateral fold lines 31*a*, 33*a* foldably connect the respective first and second side panel 17*a*, 19*a* to the front panel 15*a*. A longitudinal fold line 35*a* connects the bottom panel attachment flap 12*a* to the front panel 15*a*.

In the illustrated embodiment, the features of the back portion 11 of the blank 3 include a back panel 15*b*, a first side panel 17*b*, and a second side panel 19*b*, that are generally a mirror-image of the corresponding panel or flap of the front portion 9. A back central flap 27*b* is also similarly configured to the front central flap 27*a*, and a longitudinal fold line 129 foldably connects the front central flap 27*a* to the back central flap 27*b*. Corresponding components (e.g., panels, flaps, fold lines, cuts, etc.) have been designated by corresponding reference numbers that differ by the "a" or "b" suffix, with the "a" components corresponding to the front portion 9 and the "b" components corresponding to the back portion 11 of the blank 3.

In one embodiment, the front portion 9 includes a front central panel 41 (broadly: central panel 41) foldably connected to the second side panel 19*a* along a lateral fold line 43*a*. As shown in FIG. 1, a central bottom flap 45 is foldably connected to the front central panel 41 along a longitudinal fold line 46. A first divider flap 47 is foldably connected to the front central panel 41 at two lateral fold lines 49 with a generally U-shaped cut 50 extending between respective ends of the lateral fold lines 49. A second divider flap 51 is foldably connected to the front central panel 41 at two lateral fold lines 53 that are spaced apart by a portion of the first divider flap 47. The first divider flap 47 includes an attachment flap 55, and the second divider flap 51 includes an attachment feature 57. The attachment flap 55 is foldably connected to the first divider flap at two lateral fold lines 59 with a generally U-shaped cut 60 extending therebetween, and the attachment feature 57 is foldably connected to the second divider flap at two lateral fold lines 61. The first divider flap 47 and the attachment flap 55 are at least partially defined by a tear or cut line 63, the cut lines 50, 60, and the fold lines 49, 59. The second divider flap 51 is at least partially defined by the cut line 63, the fold lines 53, 61, and two tear or cut lines 65 that extend from a lateral edge of the blank 3 to the fold lines 53.

Figure 2:
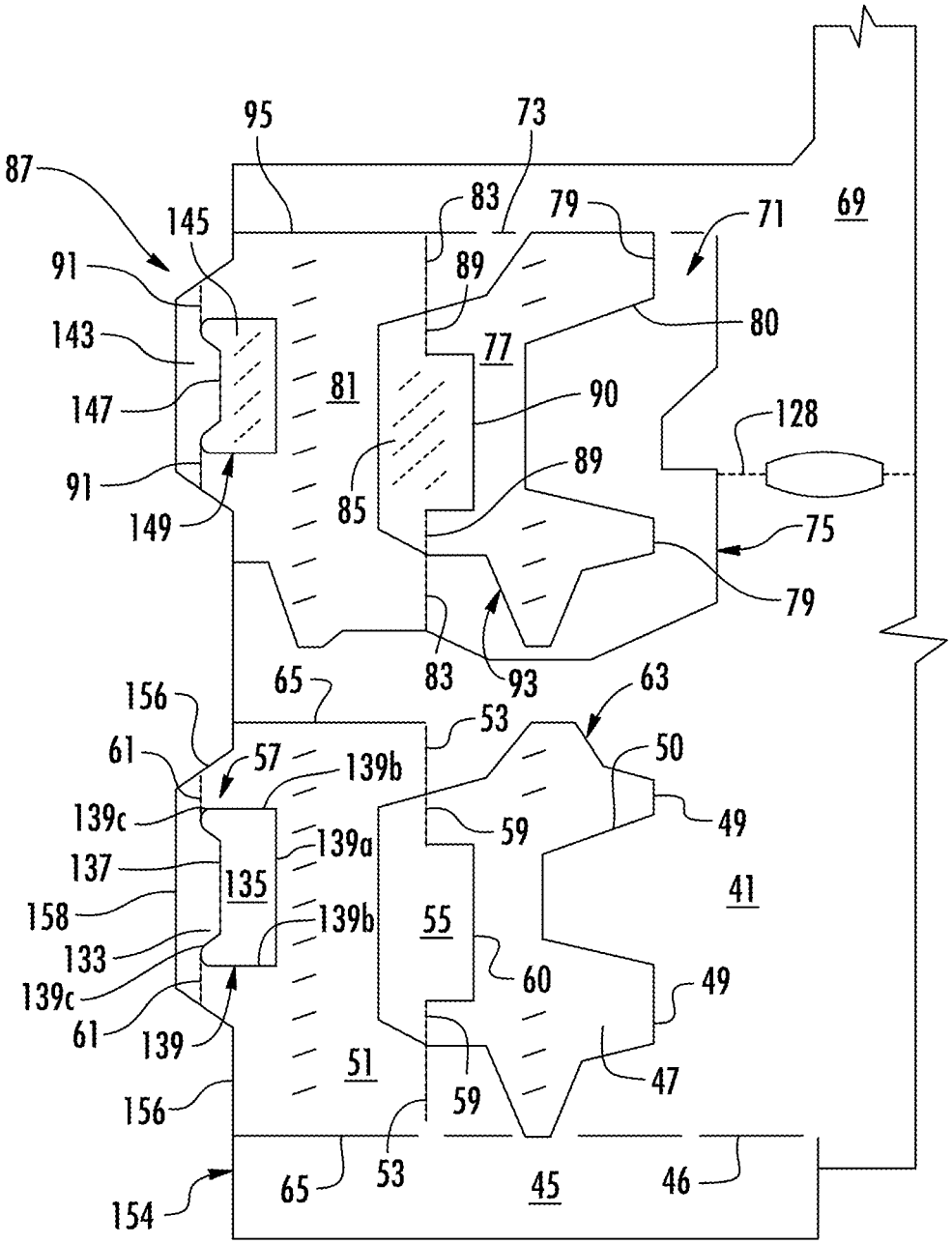
FIG. 2 is a detail plan view of a portion of the blank of FIG. 1.

FIG. 2 shows a detail view of the divider flaps 47, 51, the attachment flap 55, and the attachment feature 57. As shown in FIG. 2, the attachment feature 57 includes a hinge ear 133 (broadly "hinge panel") foldably connected to a glue tab 135 (broadly "attachment tab") along a lateral fold line 137. The glue tab 135 can be separable from the divider flap 51 and the hinge ear 133 along a tear or cut line 139. As shown in FIG. 1, the cut line 139 can include a lateral portion 139*a* disposed opposite to and generally parallel with the lateral fold line 137, two longitudinal portions 139*b* extending from respective ends of the lateral portion 139 toward the hinge ear 133, and two curved portions 139*c* extending from respective ends of the respective longitudinal portions 139*b* to the respective ends of the lateral fold line 137. The hinge ear 133 is foldably connected to the second divider flap 51 along the lateral fold lines 61, and the lateral fold line 137 is offset from the lateral fold lines 61 in the longitudinal direction L1 towards the divider flaps 47, 51 (e.g., by less than two tenths of an inch). In the illustrated embodiment, the lateral fold lines 61 can extend from the curved portions 139*c* of the cut line 139 (e.g., from the portions of the curved portions 139*c* that are farthest from the first divider flap 47). Alternatively, the lateral fold line 137 could be generally collinear with the lateral fold lines 61.

In one embodiment, the hinge ear 133 can help provide a flexible connection between the glue tab 135 and the divider flap 51, which can help reduce the amount of glue required to prevent tearing, detachment, partial detachment, and/or other failure of the attachment feature 57. As shown in FIGS. 1 and 2, the blank 3 can have an outer peripheral edge 154, and the divider flap 51 and the hinge ear 133 can have free edges 156, 158 extending along the peripheral edge 154 of the blank. Accordingly, in one embodiment, since the attachment feature 57 and the divider flap 51 project outwardly at the peripheral edge 154 of the blank 3, the attachment feature 57 can require less material at the edge 154 of the blank 3 than a larger attachment flap (e.g., similar to the attachment flap 55) helping to reduce the size and material costs of the blank and/or allowing other portions of the blank to be expanded to reinforce other portions of the carrier. In the illustrated embodiment, as shown in FIGS. 1 and 2, the attachment flap 55 lacks the hinge ear and glue tab configuration and provides an enlarged glue surface instead since the attachment flap 55 is spaced from the outer edges of the blank 3. Additionally, the flexible connection between the glue tab 135 and the divider flap 51 provided by the hinge ear 133 allows the distance between fold lines 53 and 137 to be smaller than the distance between the fold lines 49 and 59 without significantly deforming the container-receiving features 160 in the carrier 5 formed from the blank (FIGS. 4-9).

Any of the divider flaps 47, 51, the attachment flap 55, and/or the attachment feature 57 could be otherwise shaped, arranged, positioned, and/or configured without departing from the disclosure. For example, the attachment flap 55 could be replaced with an attachment feature with a hinge ear and a glue tab similar to the attachment feature 57.

As shown in FIG. 1, the back portion 11 includes a back central panel 69 foldably connected to the second side panel 19*b* along a lateral fold line 43*b*. The back central panel 69 can include a divider panel 71 foldably connected to the back central panel 69 along a longitudinal fold line 73 and separable from the front and back central panels 41, 69 along a tear or cut line 75. A first divider flap 77 (broadly: a fourth divider flap) is foldably connected to the divider panel 71 at two lateral fold lines 79 with a generally U-shaped cut 80 extending between respective ends of the lateral fold lines 79. A second divider flap 81 (broadly: a third divider flap) is foldably connected to the divider panel 71 at two lateral fold lines 83 that are spaced apart by a portion of the first divider flap 77. An attachment flap 85 can be foldably connected to the divider flap 77 at two lateral fold lines 89 with a generally U-shaped cut 90 extending therebetween. The attachment flap 85 can be similar or identical to the attachment flap 55 in one embodiment. In the illustrated embodiment, an attachment feature 87 can be foldably connected to the divider flap 81 along two fold lines 91. The attachment feature 87 can be similar or identical to the attachment feature 57. Accordingly, the attachment feature 87 can include a hinge ear 143 foldably connected to the divider flap 81 along the lateral fold lines 91 and foldably connected to a glue tab 145 along a lateral fold line 147. The glue tab 145 can be separable from the divider flap 81 and the hinge ear 143 along a cut or tear line 149, which can be similar or identical to the cut line 139.

In the illustrated embodiment, the first divider flap 77 and the attachment flap 85 are at least partially defined by a tear or cut line 93, the cut lines 80, 90, and the lateral fold lines 79, 89. The second divider flap 81 is at least partially defined by the cut lines 75, 93, 149, the lateral fold lines 83, 91, the outer peripheral edge 154 of the blank 3, and a tear or cut line 95 that extends from a lateral edge of the blank 3 to the fold line 83. In the illustrated embodiment, the front central panel 41 is foldably connected to the back central panel 69 along a line of weakening 128, which can include a fold line and an opening. Any of the front portion 9, the back portion 11, the central flaps 27*a*, 27*b*, the central panels 41, 69, the divider flaps 47, 51, 77, 81, the attachment flaps 55, 85, the attachment features 57, 87, and/or the divider panel 71 could be omitted or could be alternatively shaped, arranged, positioned, and/or configured without departing from the present disclosure.

As shown in FIG. 1, the handle panel 14 and the handle reinforcement panel 16 are generally disposed between the front and back portions 9, 11. The handle panel 14 includes a front handle portion 21*a* and a back handle portion 21*b* foldably connected to the front handle portion 21*a* along a longitudinal fold line or other line of weakening 127. The front handle portion 21*a* is foldably connected to the front central panel 41 along the lateral fold line 43*a*, and the back handle portion 21*b* is foldably connected to the back central panel 69 along the lateral fold line 43*b*. The front handle portion 21*a* can include a front handle opening 22*a* and a front handle cushion flap 25*a* foldably connected to the front handle portion along a longitudinal fold line 26*a* adjacent the front handle opening 22*a*. The back handle portion 21*b* can include a back handle opening 22*b* and a back handle cushion flap 25*b* foldably connected to the back handle portion along a longitudinal fold line 26*b* adjacent the back handle opening 22*b*. The handle panel 14 could be omitted or could be otherwise shaped, arranged, and/or configured without departing from the disclosure.

In the illustrated embodiment, the handle reinforcement panel 16 can include a front handle reinforcement portion 97*a* and a back handle reinforcement portion 97*b* foldably connected to the front handle reinforcement portion 97*a* along a longitudinal fold line or other line of weakening 115. An opening 130 can be included between the handle reinforcement portions 97*a*, 97*b* adjacent the longitudinal fold line 115. The front handle reinforcement portion 97*a* is foldably connected to the front central flap 27*a* along a lateral fold line 131*a*, and the back handle reinforcement portion 97*b* is foldably connected to the back central flap 27*b* along a lateral fold line 131*b*. In the illustrated embodiment, the lateral fold lines 131*a*, 131*b* are spaced apart or offset from the lateral fold lines 29*a*, 29*b* connecting the respective front and back central flaps 27*a*, 27*b* to the respective first side panels 17*a*, 17*b*. Alternatively, the lateral fold lines 131*a*, 131*b* can be generally collinear with the lateral fold lines 29*a*, 29*b*. In the illustrated embodiment, the front handle reinforcement portion 97*a* includes an elongate handle opening 99*a*, and the back handle reinforcement portion 97*b* includes an elongate handle opening 99*b*.

In the illustrated embodiment, the line of weakening 128 and the longitudinal fold lines 115, 127, 129 are generally aligned with the longitudinal centerline CL of the blank 3. The front handle portion 21*a* is adjacent the front panel 15*a* and the second side panel 19*a*, and the front handle reinforcement portion 97*a* is adjacent the front panel 15*a* and the first side panel 17*a*. The front handle portion 21*a* and the front handle reinforcement portion 97*a* are separable from the front panel 15*a* and the respective second side panel 19*a* and first side panel 17*a* by a tear line or cut 23*a*. Similarly, the back handle portion 21*b* and the back handle reinforcement portion 97*b* are separable from the back panel 15*b* and the respective second side panel 19*b* and first side panel 17*b* by a tear line or cut 23*b*. In the illustrated embodiment, the front and back handle reinforcement portions 97*a*, 97*b* are separable from the respective handle portions 21*a*, 21*b* along a tear or cut line 132. Alternatively, the handle reinforcement portions could be spaced apart from the handle portions. Further, any of the handle portions, the handle reinforcement portions, and/or the handle reinforcement flap could be omitted or could be otherwise shaped, arranged, positioned, and/or configured without departing from the disclosure.

Any of the panels, flaps, fold lines, cuts, or other features could be omitted or could be otherwise shaped, arranged, positioned, and/or configured in the blank 3 without departing from the disclosure. The blank 3 could be sized and/or shaped to accommodate more or less than six containers C without departing from this disclosure.

Figure 3:
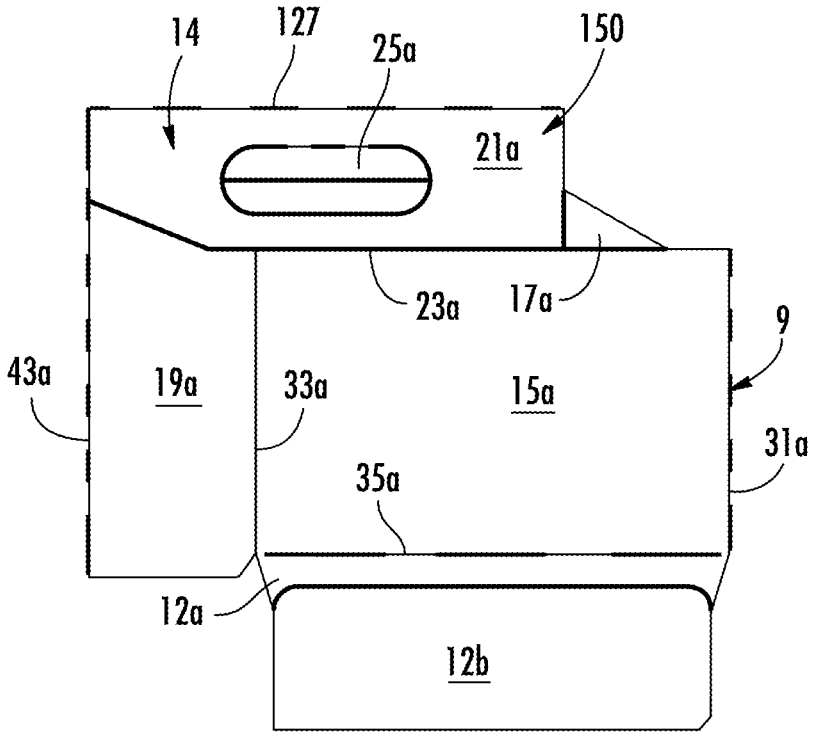
FIG. 3 is a plan view of a partially erected carrier according to the exemplary embodiment of the disclosure.
Figure 4:
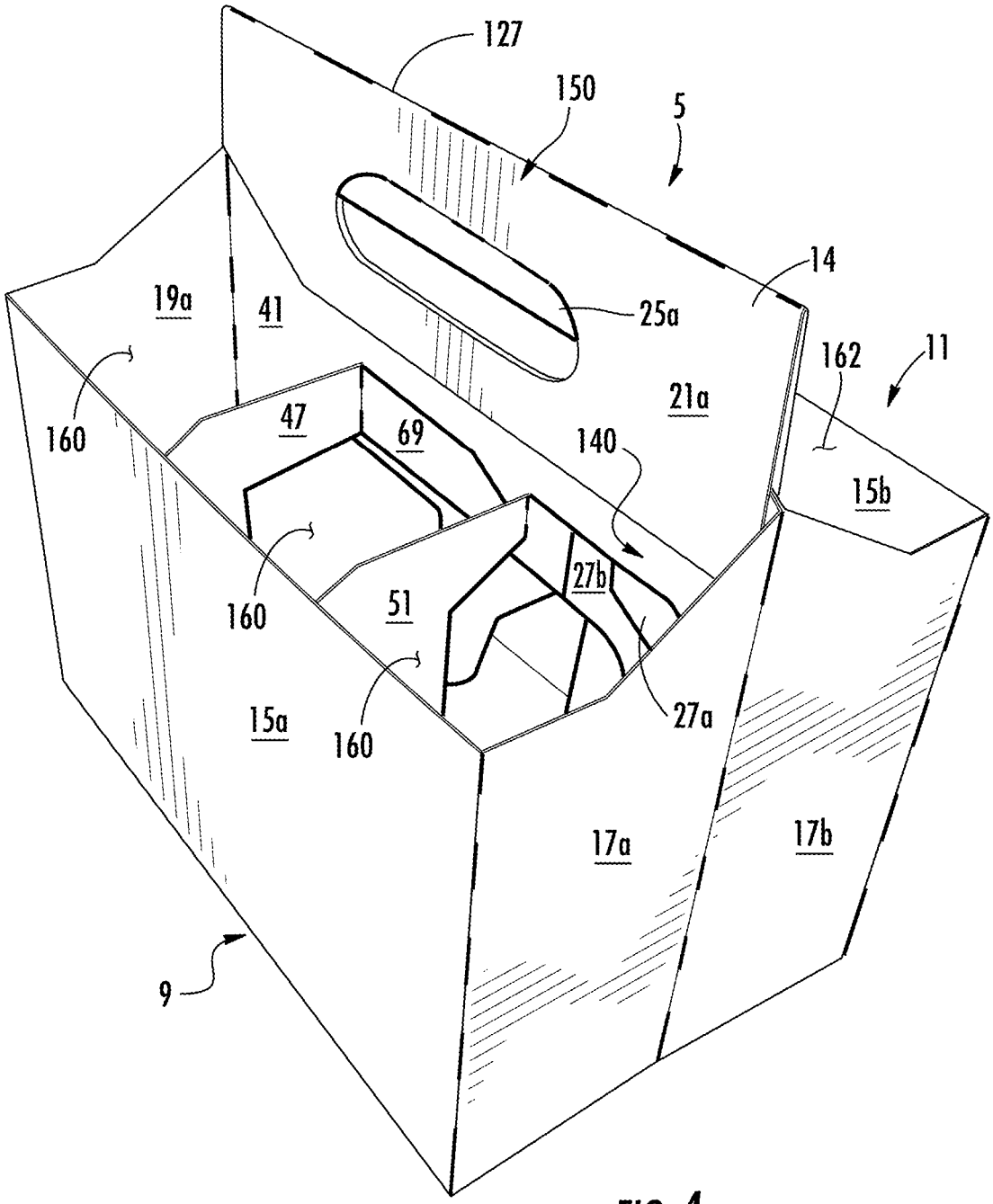
FIG. 4 is a perspective view of the assembled carrier according to the exemplary embodiment of the disclosure.
Figure 5:
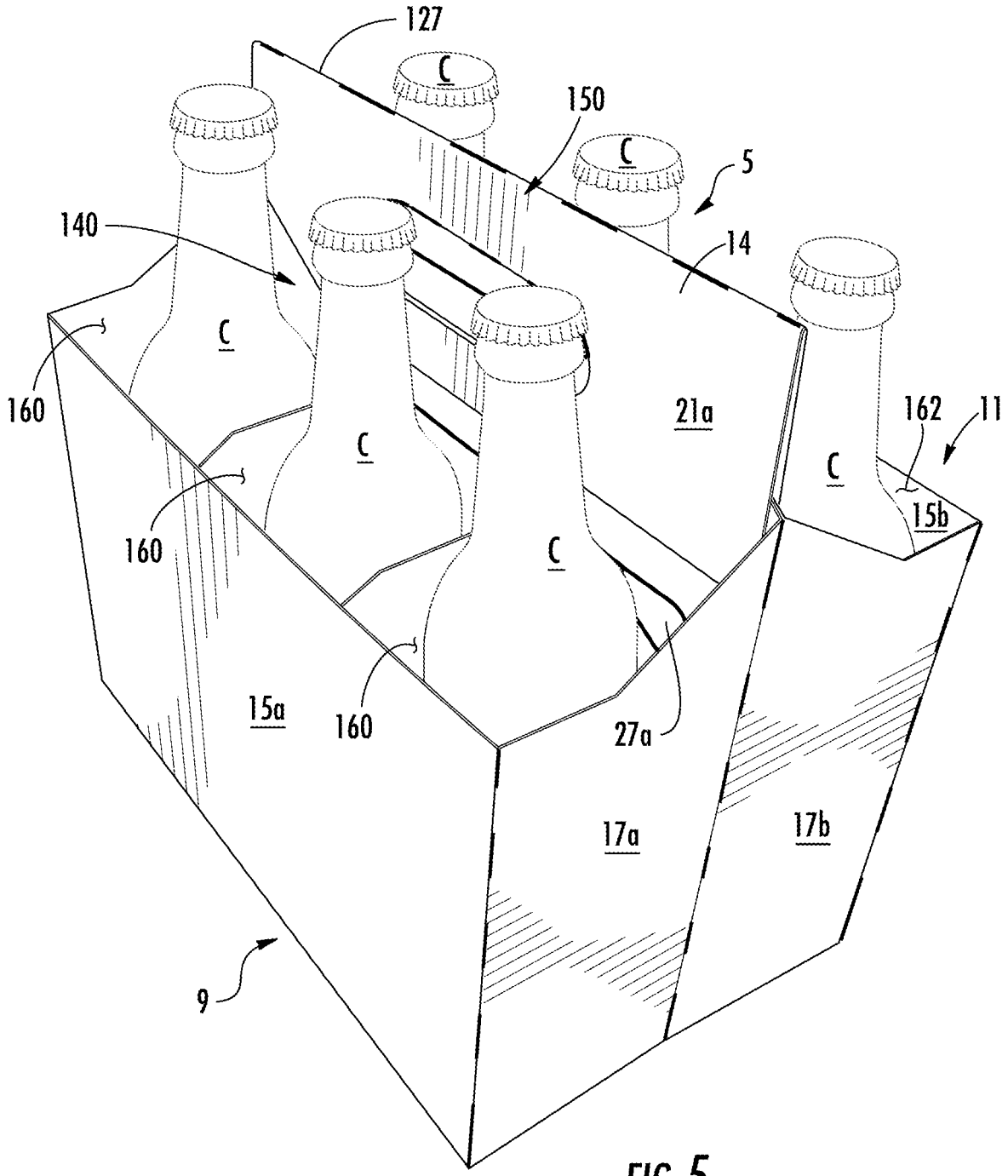
FIG. 5 is a perspective view of the carrier of FIG. 4 holding a plurality of containers according to the exemplary embodiment of the disclosure.

With reference to FIGS. 3 and 4, in one exemplary method of erection, the carrier 5 can be erected from the blank 3 by positioning the panels 15*a*, 15*b*, 17*a*, 17*b*, 19*a*, 19*b*, the central flaps 27*a*, 27*b*, the central panels 41, 69, and the divider flaps 47, 51, 77, 81 relative to each other to form the front portion 9 of the carrier and the back portion 11 of the carrier. In one embodiment, the carrier 5 can be erected in a similar method as described for the carrier in U.S. Pat. No. 9,061,810, issued Jun. 23, 2015, the entire disclosure of which is hereby incorporated by reference for all purposes as if presented herein in its entirety.

In one exemplary embodiment, the divider panel 71 can be folded along the longitudinal fold line 73 so that at least a portion of the divider panel is in face-to-face contact with the interior surface of the lower portion of the back central panel 69. The handle reinforcement panel 16 also can be folded along lateral fold lines 131*a*, 131*b* so that at least a portion of each of the front and back handle reinforcement portions 97*a*, 97*b* is in face-to-face contact with a portion of the interior surface of the respective front and back central flaps 27*a*, 27*b*. In one embodiment, the front and back handle reinforcement portions 97*a*, 97*b* can be glued to the front and back central flaps 27*a*, 27*b*.

Subsequently, the central bottom flap 45 can be folded along the longitudinal fold line 46 so that the central bottom flap is in face-to-face contact with the exterior surface of the front central panel 41. The front and back central panels 41, 69 can be folded about respective fold lines 43*a*, 43*b* so that the central panels are generally in an overlapping relationship with portions of the respective handle portions 21*a*, 21*b*, the respective second side panels 19*a*, 19*b*, and the respective front and back panels 15*a*, 15*b*. The line of weakening 128 can be generally aligned with and overlay the longitudinal fold line 127 of the handle panel 14. Glue or other adhesive can be selectively applied to the blank 3 to adhesively connect the attachment flap 55 and the glue tab 135 in face-to-face contact with the front panel 15*a* and to adhesively connect the attachment flap 85 and the glue tab 145 in face-to-face contact with the back panel 15*b*. In the illustrated embodiment, the hinge ears 133, 143 are not glued to the respective front panel 15*a* and back panel 15*b* and are free to pivot with respect to the respective front panel 15*a* and back panel 15*b* and with respect to the respective glue tab 133, 143. Additionally, in one embodiment, the portions of the central panels 41, 69 in face-to-face contact with the respective front and back handle portions 21*a*, 21*b* can be adhered or otherwise secured to the handle portions.

In one embodiment, the first side panels 17*a*, 17*b* can be folded about respective fold lines 31*a*, 31*b* so that the first side panels 17*a*, 17*b* and central flaps 27*a*, 27*b* are generally in face-to-face contact with portions of the respective front and back central panels 41, 69. Portions of the front central flap 27*a* can be selectively glued to portions of the front central panel 41 and the central bottom flap 45, and portions of the back central flap 27*b* can be selectively glued to portions of the back central panel 69. The handle reinforcement panel 16 is at least partially in face-to-face contact with the handle panel 14. Accordingly, portions of the front and back reinforcement panels 97*a*, 97*b* can be in face-to-face contact with portions of the front and back handle portions 21*a*, 21*b*, and the front and back handle reinforcement portions 97*a*, 97*b* can be glued to the front and back handle portions 21*a*, 21*b* to at least partially secure the handle reinforcement panel 16 to the handle panel 14 in one embodiment. The handle openings 99*a*, 99*b* can be generally aligned with the handle openings 22*a*, 22*b*, and the longitudinal fold lines 115, 129 and the line of weakening 128 can at least partially overlay the longitudinal fold line 127.

In the illustrated embodiment, the partially assembled blank 3 can then be folded about the longitudinal centerline CL (i.e., the longitudinal fold lines 115, 127, 129 and the line of weakening 128) so that the front portion 9 generally overlaps the back portion 11 as shown in FIG. 3. Portions of the front central panel 41 and the front central flap 27*a* can be selectively glued to portions of the respective back central panel 69 and back central flap 27*b* to generally form a central wall 140 (FIGS. 4 and 5) between the front portion 9 and the back portion 11. The handle panel 14 and the handle reinforcement panel 16 combine to form the four-ply reinforced handle 150 with the front handle openings 22*a*, 99*a* being generally aligned with the back handle openings 22*b*, 99*b*. The bottom panel 12*b* can be folded along a fold line and attached to the bottom panel attachment flap 12*a* by glue so that the partially assembled blank 3 has the flattened configuration shown in FIG. 4. The central wall 140, the reinforced handle 150, and/or the bottom of the carrier 5 could be otherwise shaped, arranged, positioned, and/or configured without departing from the disclosure.

The blank 3 can be further assembled into the carrier 5, as shown in FIG. 4, by positioning the first side panels 17*a*, 17*b* and second side panels 19*a*, 19*b* to be in a generally spaced-apart, parallel planar relationship, and positioning the front panel 15*a* and back panel 15*b* to be in a generally spaced-apart, parallel planar relationship. Such movement of the side panels 17*a*, 17*b*, 19*a*, 19*b* and front and back panels 15*a*, 15*b*, causes the divider flaps 47, 51 in the front portion 9 of the carrier 5 to be positioned generally perpendicular to the front central panel 41 and the front panel 15*a*, thereby dividing the front portion 9 into three container-receiving spaces 160 (FIG. 4). Similarly, the back portion 11 of the carrier is divided into three container-receiving spaces 162 by the divider flaps 77, 81 (FIGS. 6-9). The separating of the front and back panels 15*a*, 15*b* further pulls the bottom panel 12*b* flat across the bottom of the carrier 5. Two hooks 13*a*, 13*b* (FIG. 1) disposed at the bottoms of the respective central flaps 27*a*, 27*b* can engage a notch 28 (FIG. 1) in the bottom panel 12*b* for supporting the bottom panel.

In the illustrated embodiment, the divider flaps 47, 51 and 77, 81 can extend at least partially from the respective central panels 41, 69 to the respective front panel 15*a* and back panel 15*b*. As the front panel 15*a* is positioned opposite to the front central panel 41, the attachment flap 55 and the attachment feature 57 fold with respect to the respective divider flaps 47, 51 so that the attachment flap 55 and the attachment feature 57 separate from the respective divider flaps 47, 51. In one embodiment, the attachment flap 55 can separate from the divider flaps 47, 51 along the respective cut lines 60, 63 and fold along fold lines 59 to extend generally perpendicular to the divider flap 47. In one embodiment, the attachment flap 55 can extend from the fold lines 59 on both sides of the divider flap 47. Similarly, the glue tab 135 can separate from the divider flap 51 along the cut line 139, and the divider flap 51 can fold along lateral fold lines 61 to be generally perpendicular to the glue tab 135 and the hinge ear 133. The attachment flap 85 and the attachment feature 87 can similarly separate from the respective divider flaps 77, 81 as the back panel 15*b* is positioned opposite to the back central panel 69. In the illustrated embodiment, when the glue tabs 135, 145 separate from the respective divider flaps 51, 81, respective openings 152 that are complimentary in shape with the glue tabs 135, 145 can be formed in the respective divider flaps 51, 81 adjacent the respective hinge ears 133, 143 (e.g., the opening 152 in the divider flap 81 is shown in FIGS. 6-9). As shown in FIGS. 6-9, the glue tab 145 and a portion of the hinge ear 143 can extend from the lateral fold line 91 on one side of the divider flap 81, and another portion of the hinge ear 143 can extend on an opposing side of the divider flap 81 in the erected carrier 5. Accordingly, the lateral fold line 147 is spaced apart from the divider flap 81 by a portion of the hinge ear 143. The hinge ear 133 and the glue tab 135 can be similarly arranged with respect to the divider flap 51 in one embodiment.

The carrier 5 can be alternatively erected, formed, and/or arranged without departing from the present disclosure.

In one embodiment, containers C, such as bottles, can be placed into the container-receiving spaces 160, 162 of the carrier 5 (FIG. 5). The bottoms of the containers are supported by the bottom panel 12*b*, and the divider flaps 47, 51, 77, 81 generally can extend between the wider lower portions of the containers C to help prevent the containers from contacting respectively adjacent containers.

Figure 6:
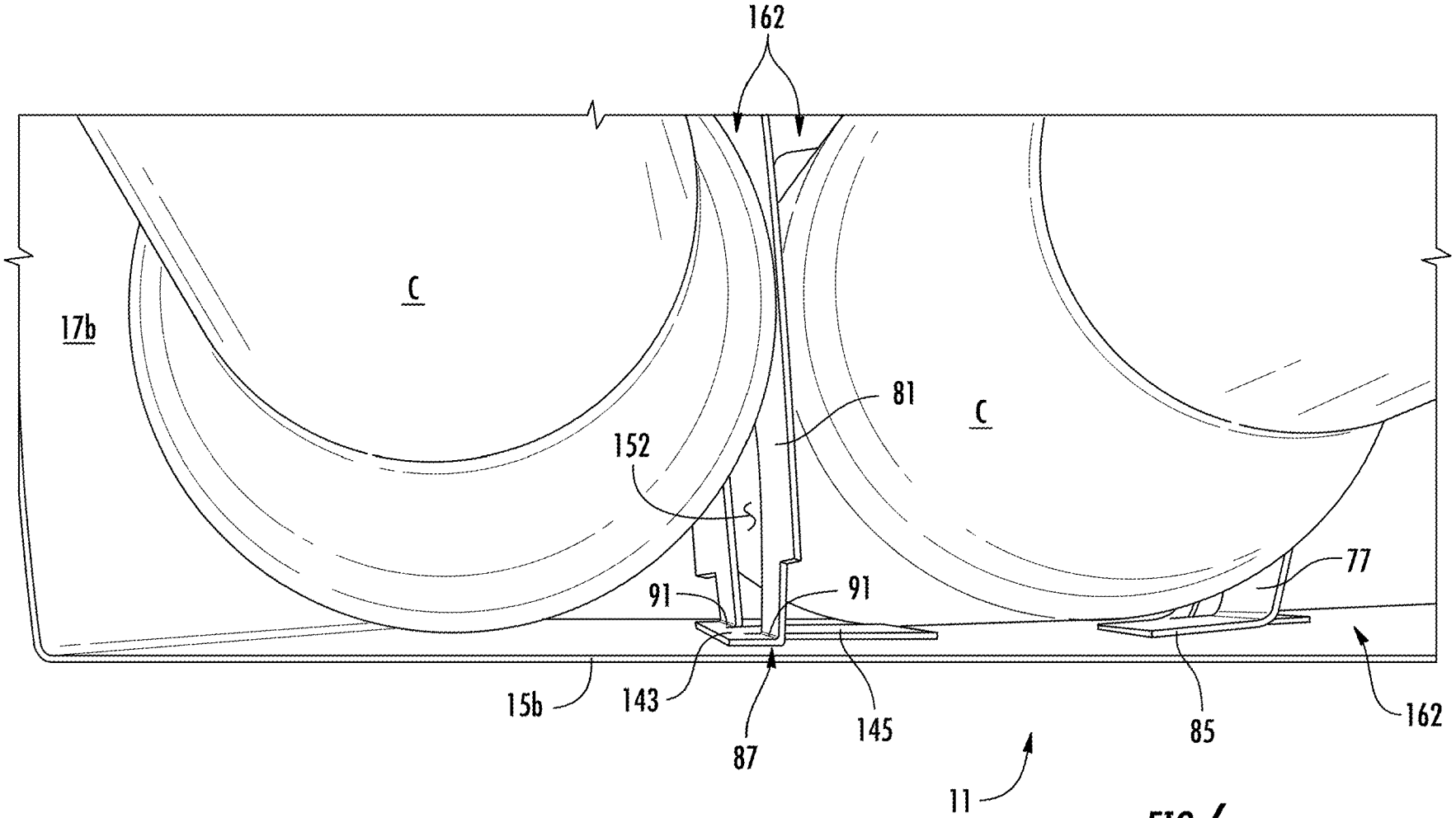
FIGS. 6-9 are perspective detail views of the carrier of FIGS. 4 and 5.

FIGS. 6-9 illustrate features of the attachment feature 87 and the divider flap 81 in the back portion 11 of the carrier 5. In the illustrated embodiment, the attachment feature 57 in the front portion 9 of the carrier can be similar or identical to the attachment feature 87. As shown in FIG. 6, the divider flap 81 can extend between two container-receiving spaces 162 in the back portion 11 of the carrier 5. The divider flap 81 can be generally perpendicular to the back panel 15*b*, and the attachment feature 87 can be folded with respect to the divider flap 81 along the lateral fold lines 91 to be generally in face-to-face contact with the back panel 15*b*. However, in the illustrated embodiment, only the glue tab 145 of the attachment feature 87 is adhered to the back panel 15*b*. Accordingly, the hinge ear 143 is generally free to pivot with respect to the divider flap 81 and the glue tab 145 along the respective lateral fold lines 91, 147. Accordingly, the hinge ear 143 can help provide additional freedom for the divider flap 81 to move with respect to the glue tab 145 and the back panel 15*b* to help avoid tearing of the divider or separation of the glue tab 145 from the back panel 15*b* when stress is applied to the carrier 5.

Figure 7:
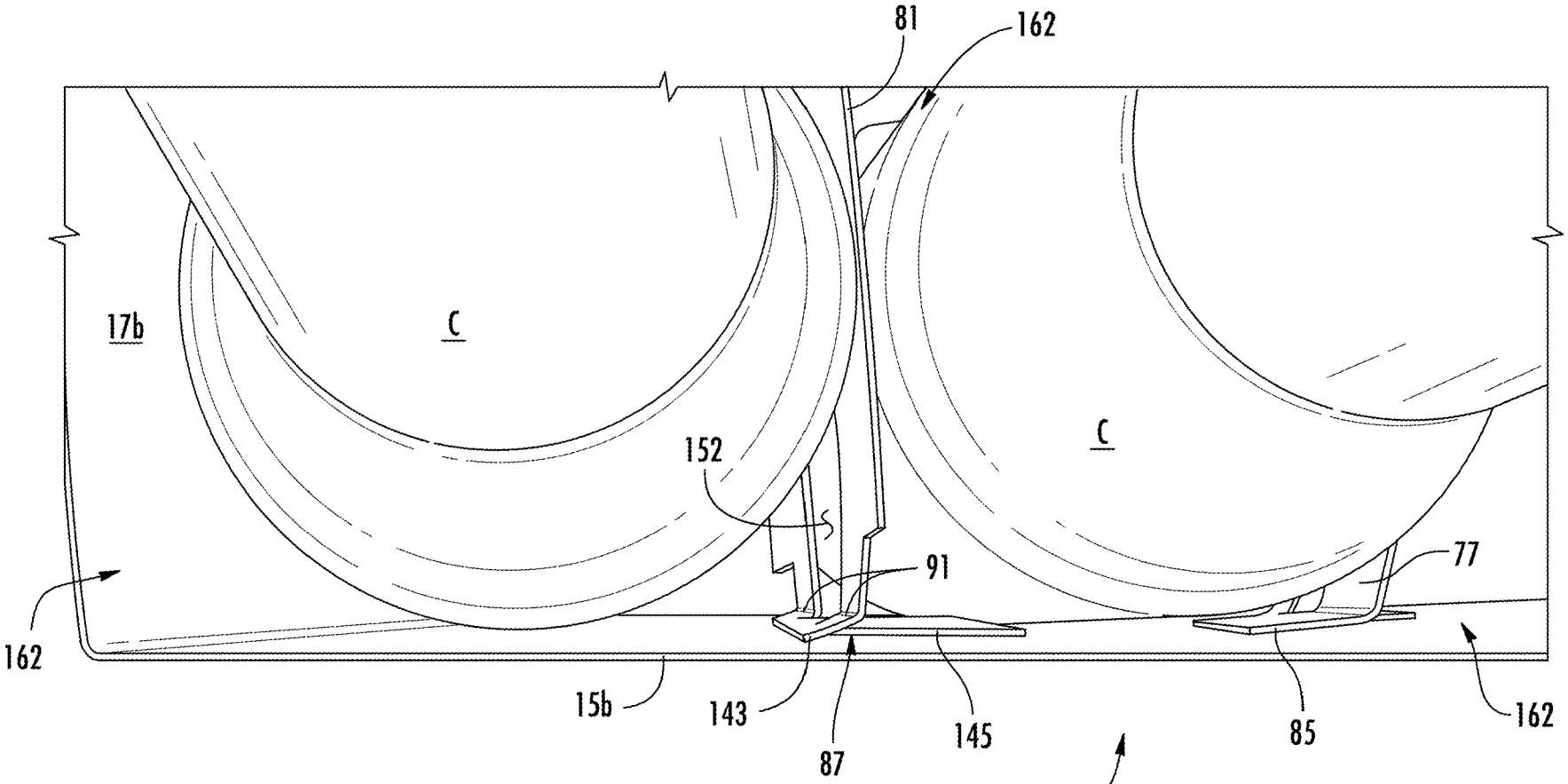
Figure 8:
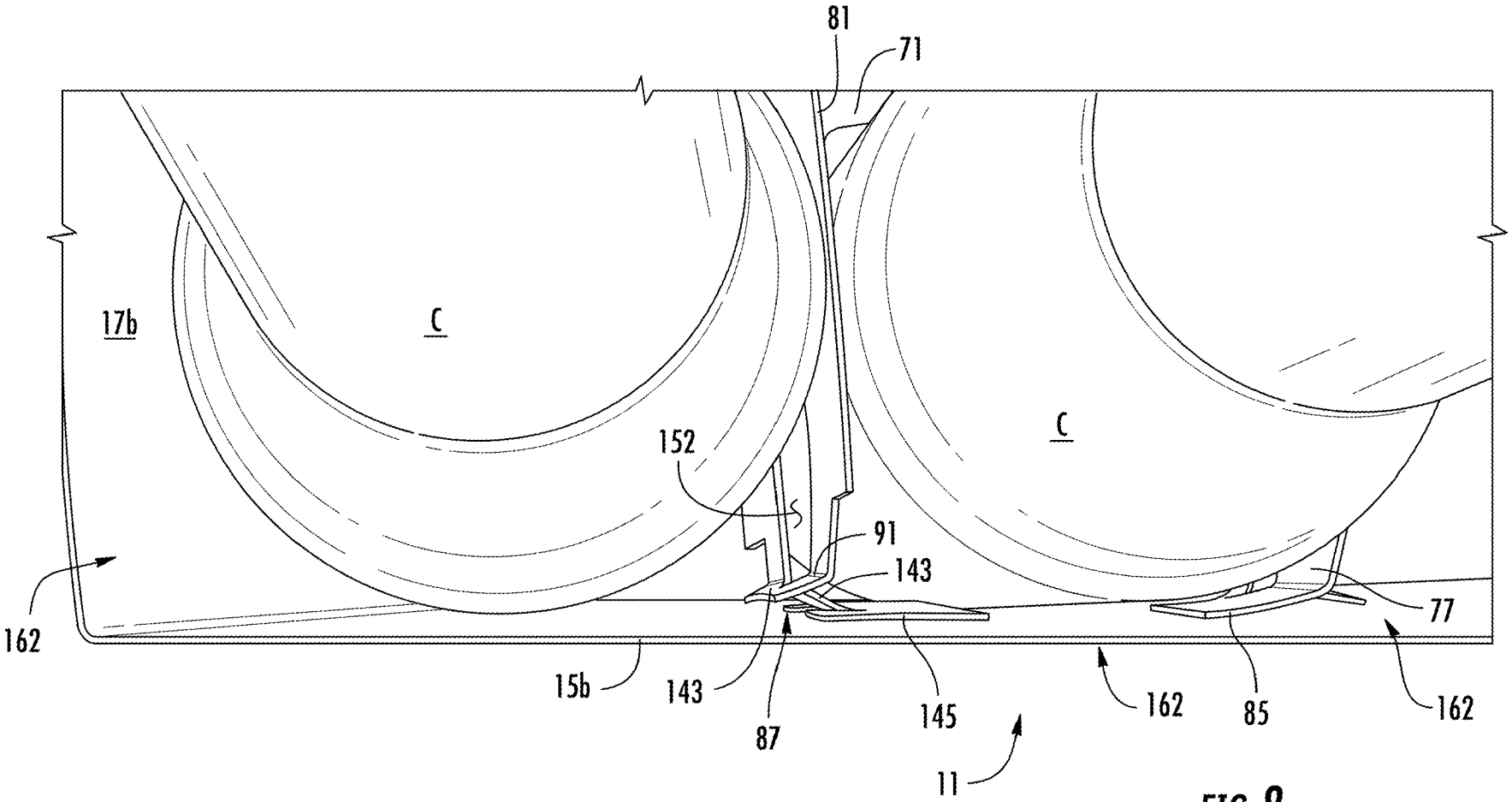
Figure 9:
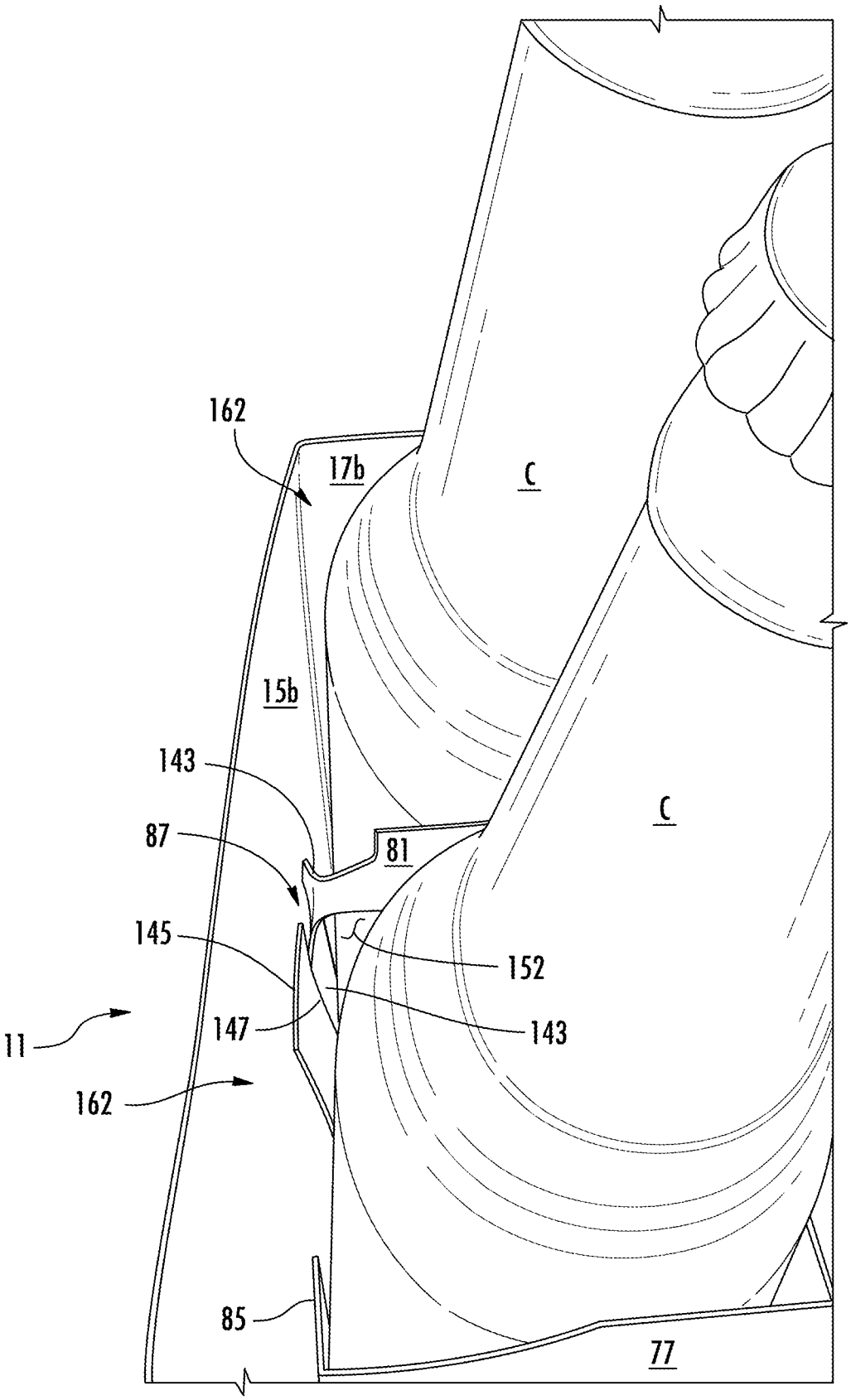

As shown in FIGS. 7-9, the back panel 15*b* can be pushed inwardly and pulled outwardly with respect to the interior of the carrier 5 such as by movement of the containers C and/or opening of the carrier 5. This movement of the back panel 15*b* can cause the hinge ear 143 to separate from the back panel 15*b* and pivot with respect to the divider flap 81 and the glue tab 145 along the respective fold lines 91, 147. For example, FIGS. 7-9 show different exemplary amounts of flexing of the back panel 15*b* with respect to the divider flap 81 and the related flexing of the hinge ear 143. Accordingly, the attachment feature 87 can help promote flexing and/or morphing of the connection between the divider flap 81 and the back panel 15*b* rather than tearing of the panels and flaps or failing of a glued connection. This allows a smaller amount of glue to be used to attach the divider to the back panel when compared to an attachment flap that is directly connected to the divider flap (e.g., the attachment flaps 55, 85). Accordingly, the surface area (e.g., glue area) of the glue tab 145 (and the glue tab 135 in the front portion 9 of the carrier) can be reduced with respect to the attachment flaps 55, 85. Since the glue tabs 135, 145 are disposed at the outer peripheral edge 154 of the blank 3, smaller glue tabs help to reduce the amount of material and the overall surface area of the blank 3. Also, the smaller attachment features 57, 87 (including the glue tabs 135, 145 and the hinge ears 133, 143) at the outer periphery 154 of the blank 3 can help allow for a better layout of multiple blanks 3 in a web from which the blanks are cut so that more blanks can fit on a web and/or less web material is wasted. Alternatively, or in addition, the reduction in size of the glue tabs 135, 145 can allow other areas of the blank 3 to increase in size. For example, the central flaps 27*a*, 27*b* can be widened to help reinforce the central wall 140 of the carrier 5 at the side panels 17*a*, 17*b*. Accordingly, in the illustrated embodiment, each of the attachment features 57, 87 (including the respective hinge ears 133, 143 and the respective glue tabs 135, 145) are smaller than (e.g., have less surface area) each of the attachment flaps 55, 85.

In one embodiment, distance from the fold line 53 to the fold line 137 of the divider flap 51 is generally shorter (e.g., by about 0.25 inch in one exemplary embodiment) than the distance between fold lines 49 and 59 of the divider flap 47. This is because the fold line 137 is offset from the fold lines 61. The distance between fold lines 49 to 59 of the divider flap 47 generally is equal to the distance between the central panel 41 and the front panel 15*a* in the erected carrier 5. However, the connection of the glue tab 135 to the divider flap 51 via the hinge ear 133 allows the distance between the fold lines 53, 137 to be smaller than the distance between the central panel 41 and the front panel 15*a* without necessarily causing the container-receiving opening 160 to open and collapse irregularly or causing tearing of the flaps and/or panels. Any dimensions are included by way of example only. The blank 3 and the carton 5 can have other sizes, shapes, and configurations without departing from the disclosure.

The exemplary carrier embodiment discussed above accommodates six containers C arranged in two rows, but the present disclosure is not limited to these numbers. As one example, additional containers may be accommodated by increasing the size of the blank 3 (e.g., in the longitudinal direction L1 in FIG. 1) and forming additional container-receiving spaces therein. Also, the carrier 5 could have less than six container-receiving spaces.

The panels, flaps, and other features shown and described in conjunction with the blank 3 and the carrier 5 are included by way of example. The attachment features 57, 87 and/or other features of the disclosure can alternatively be associated with any basket-style carrier or other type of carton having any divider or panel configuration.

In general, the blank may be constructed from paperboard having a caliper so that it is heavier and more rigid than ordinary paper. The blank can also be constructed of other materials, such as cardboard, or any other material having properties suitable for enabling the carrier or carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels that forms an interior of the carrier, the plurality of panels comprising at least a front panel and a central panel, the interior of the carrier being divided into a front portion and a back portion by at least the central panel;

a divider flap foldably connected to the central panel, the divider flap extending at least partially from the central panel to the front panel; and a hinge panel and an attachment tab, the hinge panel being foldably connected to the divider flap along a first fold line, and the attachment tab being foldably connected to the hinge panel along a second fold line, wherein the attachment tab and the front panel at least partially overlap one another, and the hinge panel is free to pivot with respect to the divider flap along the first fold line.

2. The carrier of claim 1, wherein the attachment tab is adhered at least partially in face-to-face contact with the front panel, and the hinge panel is free to pivot at least partially away from the front panel along at least one of the first fold line and the second fold line.

3. The carrier of claim 1, wherein the second fold line is offset from the first fold line.

4. The carrier of claim 3, wherein the second fold line is spaced apart from the divider flap by at least a portion of the hinge panel.

5. The carrier of claim 3, wherein the divider flap at least partially defines an opening extending adjacent the hinge panel, and the first fold line extends from an edge of the opening.

6. The carrier of claim 5, wherein the attachment tab is at least partially complementary in shape to the opening in the divider flap.

7. The carrier of claim 1, wherein the attachment tab extends on a first side of the divider flap, and at least a portion of the hinge panel extends from the first fold line to the second fold line on the first side of the divider flap.

8. The carrier of claim 1, wherein the divider flap is a second divider flap, and the carrier comprises a first divider flap foldably connected to the central panel, the first divider flap extending at least partially from the central panel to the front panel.

9. The carrier of claim 8, further comprising an attachment flap foldably connected to the first divider flap along a third fold line.

10. The carrier of claim 9, wherein each of the attachment tab and the attachment flap is respectively glued in face-to-face contact with the front panel, and the hinge panel is free to pivot at least partially away from the front panel along at least one of the first fold line and the second fold line.

11. The carrier of claim 9, wherein the attachment flap is larger than the hinge panel and the attachment tab, combined.

12. The carrier of claim 9, wherein:

the central panel is a front central panel;

the plurality of panels further comprises a back panel and a back central panel, the front central panel and the back central panel at least partially overlapping one another; and the carrier further comprises a divider panel foldably connected to the back central panel, a third divider flap foldably connected to the divider panel, and a fourth divider flap foldably connected to the divider panel, each of the third divider flap and the fourth divider flap extending at least partially from the divider panel to the back panel.

13. The carrier of claim 12, wherein the hinge panel is a first hinge panel, the attachment tab is a first attachment tab, the attachment flap is a first attachment flap, and the carrier further comprises a second attachment flap foldably connected to the fourth divider flap, a second hinge panel foldably connected to the third divider flap, and a second attachment tab foldably connected to the second hinge panel.

14. The carrier of claim 13, wherein each of the first attachment tab and the first attachment flap is adhered at least partially in face-to-face contact with the front panel, each of the second attachment tab and the second attachment flap is adhered at least partially in face-to-face contact with the back panel, and each of the first hinge panel and the second hinge panel is free to pivot at least partially away from each of the respective front panel and respective back panel with respect to the respective first attachment tab and respective second attachment tab.

15. The carrier of claim 1, wherein:

the central panel is a front central panel and the divider flap is a first divider flap;

the plurality of panels further comprises a back panel and a back central panel, the front central panel and the back central panel at least partially overlapping one another; and the carrier further comprises a divider panel foldably connected to the back central panel and a second divider flap foldably connected to the divider panel, the second divider flap extending at least partially from the divider panel to the back panel.

16. The carrier of claim 15, wherein the hinge panel is a first hinge panel, the attachment tab is a first attachment tab, and the carrier further comprises a second hinge panel foldably connected to the second divider flap and a second attachment tab foldably connected to the second hinge panel.

17. The carrier of claim 16, wherein the first attachment tab is adhered at least partially in face-to-face contact with the front panel, the second attachment tab is adhered at least partially in face-to-face contact with the back panel, and each of the first hinge panel and the second hinge panel is free to pivot at least partially away from the respective front panel and respective back panel with respect to the respective first attachment tab and respective second attachment tab.

18. The carrier of claim 1, further comprising a handle comprising a handle panel foldably connected to the central panel and at least partially overlapping the central panel above the divider flap.

19. The carrier of claim 1, wherein the plurality of panels further comprises a side panel foldably connected to each of the front panel and the central panel.

20. The carrier of claim 1, wherein the hinge panel is nonparallel with the divider flap.

21. A blank for forming a carrier for holding a plurality of containers, the blank comprising:

a plurality of panels comprising at least a front panel and a central panel, the central panel being for at least partially dividing an interior of the carrier formed from the blank into a front portion and a back portion;

a divider flap foldably connected to the central panel, the divider flap being for extending at least partially from the central panel to the front panel when the carrier is formed from the blank; and a hinge panel and an attachment tab, the hinge panel being foldably connected to the divider flap along a first fold line, and the attachment tab being foldably connected to the hinge panel along a second fold line, wherein the attachment tab and the front panel are for at least partially overlapping one another when the carrier is formed from the blank, and the hinge panel is for being free to pivot with respect to the divider flap along the first fold line when the carrier is formed from the blank, wherein a centerline of the blank intersects the hinge panel of the divider flap.

22. The blank of claim 21, wherein the attachment tab is for being adhered at least partially in face-to-face contact with the front panel when the carrier is formed from the blank, and the hinge panel is for being free to pivot at least partially away from the front panel along at least one of the first fold line and the second fold line when the carrier is formed from the blank.

23. The blank of claim 21, wherein the second fold line is offset from the first fold line.

24. The blank of claim 23, wherein the second fold line is spaced apart from the divider flap by at least a portion of the hinge panel.

25. The blank of claim 23, wherein the attachment tab is at least partially defined by a cut line extending at least in the divider flap, and the first fold line extends from the cut line.

26. The blank of claim 25, wherein the cut line comprises a curved portion extending from each respective end of the second fold line, and the attachment tab is at least partially separable from the hinge panel along each of the curved portions of the cut line.

27. The blank of claim 21, wherein the blank comprises a peripheral edge, the hinge panel comprises a free edge, and at least a portion of the free edge of the hinge panel extends along the peripheral edge of the blank.

28. The blank of claim 27, wherein the free edge of the hinge panel is a first free edge, the divider flap comprises a second free edge, and at least a portion of the second free edge of the divider flap extends along the peripheral edge of the blank.

29. The blank of claim 21, wherein the divider flap is a second divider flap, the blank further comprises a first divider flap foldably connected to the central panel, and the first divider flap is for extending at least partially from the central panel to the front panel when the carrier is formed from the blank.

30. The blank of claim 29, further comprising an attachment flap foldably connected to the first divider flap along a third fold line.

31. The blank of claim 30, wherein the attachment flap is at least partially separable from the second divider flap along a first cut line and is at least partially separable from the first divider flap along a second cut line.

32. The blank of claim 31, wherein the attachment tab is at least partially separable from the second divider flap and the hinge panel along a third cut line.

33. The blank of claim 30, wherein the attachment flap is larger than the hinge panel and the attachment tab, combined.

34. The blank of claim 30, wherein the blank comprises a peripheral edge, the hinge panel comprises a free edge, at least a portion of the free edge of the hinge panel extends along the peripheral edge of the blank, and the attachment flap is spaced apart from the peripheral edge of the blank.

35. The blank of claim 30, wherein:

the central panel is a front central panel;

the plurality of panels further comprises a back panel and a back central panel, the front central panel and the back central panel being for at least partially overlapping one another when the carrier is formed from the blank; and the blank further comprises a divider panel foldably connected to the back central panel, a third divider flap foldably connected to the divider panel, and a fourth divider flap foldably connected to the divider panel, each of the third divider flap and the fourth divider flap being for extending at least partially from the divider panel to the back panel when the carrier is formed from the blank.

36. The blank of claim 35, wherein the hinge panel is a first hinge panel, the attachment tab is a first attachment tab, the attachment flap is a first attachment flap, and the blank further comprises a second attachment flap foldably connected to the fourth divider flap, a second hinge panel foldably connected to the third divider flap, and a second attachment tab foldably connected to the second hinge panel.

37. The blank of claim 36, wherein each of the first attachment tab and the first attachment flap is for being adhered at least partially in face-to-face contact with the front panel when the carrier is formed from the blank, each of the second attachment tab and the second attachment flap is for being adhered at least partially in face-to-face contact with the back panel when the carrier is formed from the blank, and each of the first hinge panel and the second hinge panel is for being free to pivot at least partially away from each of the respective front panel and respective back panel with respect to the respective first attachment tab and respective second attachment tab when the carrier is formed from the blank.

38. The blank of claim 36, wherein the blank comprises a peripheral edge, the first hinge panel comprises a first free edge, the second hinge panel comprises a second free edge, and at least a portion of each of the first free edge and the second free edge extends along the peripheral edge of the blank.

39. The blank of claim 38, wherein each of the first attachment flap and the second attachment flap is spaced apart from the peripheral edge of the blank, and each of the first attachment flap and the second attachment flap is larger than each combination of the first hinge panel with the first attachment tab and the second hinge panel with the second attachment tab.

40. The blank of claim 21, wherein:

the central panel is a front central panel and the divider flap is a front divider flap;

the plurality of panels further comprises a back panel and a back central panel, the front central panel and the back central panel being for at least partially overlapping one another when the carrier is formed from the blank; and the blank further comprises a divider panel foldably connected to the back central panel and a back divider flap foldably connected to the divider panel, the back divider flap being for extending at least partially from the divider panel to the back panel when the carrier is formed from the blank.

41. The blank of claim 40, wherein the the hinge panel is a first hinge panel, the attachment tab is a first attachment tab, and the blank further comprises a second hinge panel foldably connected to the back divider flap and a second attachment tab foldably connected to the second hinge panel.

42. The blank of claim 41, wherein the blank comprises a peripheral edge, the first hinge panel comprises a first free edge, the second hinge panel comprises a second free edge, and at least a portion of each of the first free edge and the second free edge extends along the peripheral edge of the blank.

43. The blank of claim 21, further comprising handle features for forming a handle when the carrier is formed from the blank, the handle features comprising a handle panel foldably connected to the central panel.

44. The blank of claim 21, wherein the plurality of panels further comprises a side panel foldably connected to each of the front panel and the central panel.

45. The blank of claim 21, wherein the hinge panel is for being nonparallel with the divider flap when the carrier is formed from the blank.

46. A method of forming a carrier for holding a plurality of containers, the method comprising:

obtaining a blank comprising a plurality of panels comprising at least a front panel and a central panel, a divider flap foldably connected to the central panel, a hinge panel, and an attachment tab, the hinge panel being foldably connected to the divider flap along a first fold line, and the attachment tab being foldably connected to the hinge panel along a second fold line; and forming an interior of the carrier by respectively folding the plurality of panels, the forming the interior of the carrier comprising positioning the central panel to at least partially divide the interior of the carrier into a front portion and a back portion and positioning the divider flap to extend at least partially from the central panel to the front panel so that the attachment tab and the front panel at least partially overlap one another, wherein, in the formed carrier, the hinge panel is free to pivot with respect to the divider flap along the first fold line.

47. The method of claim 46, further comprising adhering the attachment tab at least partially in face-to-face contact with the front panel, the hinge panel being free to pivot at least partially away from the front panel along at least one of the first fold line and the second fold line.

48. The method of claim 46, wherein the attachment tab is at least partially defined by a cut line extending in at least the divider flap, and the positioning the divider flap comprises folding the hinge panel and the attachment tab about at least the first fold line so that the attachment tab at least partially separates from the divider flap along the cut line.

49. The method of claim 46, wherein the divider flap is a first divider flap, the blank further comprises a second divider flap foldably connected to the central panel and an attachment flap foldably connected to the second divider flap, and the forming the blank further comprises positioning the second divider flap to extend at least partially from the central panel to the front panel so that the attachment flap and the front panel at least partially overlap one another.

50. The method of claim 46, wherein the central panel is a front central panel and the divider flap is a first divider flap, the plurality of panels further comprises a back panel and a back central panel, and the blank further comprises a divider panel foldably connected to the back central panel and a second divider flap foldably connected to the divider panel; and the method further comprises positioning the back central panel and the front central panel to at least partially overlap one another, the forming the interior of the carrier further comprising positioning the second divider flap to extend at least partially from the divider panel to the back panel.

51. The method of claim 50, wherein:

the hinge panel is a first hinge panel and the attachment tab is a first attachment tab;

the blank further comprises a second hinge panel foldably connected to the second divider flap and a second attachment tab foldably connected to the second hinge panel; and the method further comprises adhering the first attachment tab at least partially in face-to-face contact with the front panel and adhering the second attachment tab at least partially in face-to-face contact with the back panel, each of the first hinge panel and the second hinge panel being free to pivot at least partially away from each of the respective front panel and respective back panel with respect to the respective first attachment tab and respective second attachment tab.

* * * * *